US006973995B1

(12) United States Patent
Diggle III et al.

(10) Patent No.: US 6,973,995 B1
(45) Date of Patent: Dec. 13, 2005

(54) INTEGRATED SUPPORT DEVICE AND METHOD

(75) Inventors: Frederick James Diggle III, Birmingham, AL (US); Paul Brent Rivers, Cullman, AL (US); Robert Clint Hogeland, Fultondale, AL (US)

(73) Assignee: BellSouth Intellectual Property Corp., Wilmington, DE (US)

( * ) Notice: Subject to any disclaimer, the term of this patent is extended or adjusted under 35 U.S.C. 154(b) by 54 days.

(21) Appl. No.: 10/646,137

(22) Filed: Aug. 22, 2003

Related U.S. Application Data

(63) Continuation-in-part of application No. 10/409,013, filed on Apr. 8, 2003, now abandoned.

(51) Int. Cl.[7] ..... A47L 3/04; A63B 27/00
(52) U.S. Cl. ..... 182/9; 182/133
(58) Field of Search ..... 182/3, 9, 133, 182/136, 187, 5, 6, 7, 134, 135, 188, 129

(56) References Cited

U.S. PATENT DOCUMENTS

| | | | | |
|---|---|---|---|---|
| 1,721,516 | A * | 7/1929 | Jacobs | 182/9 |
| 2,152,049 | A | 3/1939 | Hedrick | |
| 2,290,318 | A * | 7/1942 | Deike, Jr. et al. | 182/3 |
| 3,743,050 | A | 7/1973 | Danz | |
| 3,840,091 | A | 10/1974 | Conlon | |
| 4,137,995 | A | 2/1979 | Fonte | |
| 4,407,391 | A | 10/1983 | Greenway et al. | |
| 4,506,762 | A | 3/1985 | Bednar | |
| 4,527,660 | A | 7/1985 | Andruchiw | |
| 4,679,658 | A | 7/1987 | Demers | |
| 4,923,048 | A | 5/1990 | Cole | |
| 4,951,778 | A | 8/1990 | Halvorson | |
| 5,052,514 | A | 10/1991 | Rezmer | |
| 5,165,499 | A | 11/1992 | Bell | |
| 5,222,991 | A | 6/1993 | Bell | |
| 6,206,138 | B1 | 3/2001 | Yerger | |
| 6,223,854 | B1 | 5/2001 | Nolz | |
| 6,241,045 | B1 | 6/2001 | Reeve et al. | |
| 6,644,438 | B1 | 11/2003 | Chang et al. | |

OTHER PUBLICATIONS

United States Application; Express Mail Label No. EU 560 994 055 US.
U.S. Appl. No. 10/409,013, filed Apr. 8, 2003.
U.S. Appl. No. 10/639,973, filed Aug. 13, 2003.
U.S. Appl. No. 10/641,311, filed Aug. 14, 2003.
U.S. Appl. No. 10/650,276, filed Aug. 27, 2003.

* cited by examiner

*Primary Examiner*—Hugh B. Thompson, II
(74) *Attorney, Agent, or Firm*—Potomac Patent Group PLLC

(57) ABSTRACT

A support device secures a technician to a pole during elevated line work. The support device may be integrated with a safety strap to keep the technician from falling if the gaffs of the technician cut out from the pole.

19 Claims, 3 Drawing Sheets

INTEGRATED SUPPORT DEVICE AND METHOD

This application is a continuation-in-part of U.S. patent application Ser. No. 10/409,013, filed on Apr. 8, 2003 now abandoned.

TECHNICAL FIELD

The invention, in various embodiments, relates generally to devices and methods for their use in working on, for example, utility poles.

BACKGROUND

In the telecommunications or electronics industry, it is common practice for a technician (also referred to as a "linesman") to scale a utility pole. The technician scales the utility pole to install equipment, to repair broken or damaged communications equipment, to test equipment, and/or for other work-related reasons. To safely and effectively scale a pole and perform line work, the technician must maintain and properly utilize various types of scaling and safety equipment. To utilize the various types of scaling and safety equipment, the technician must also have the skills and the physical ability to sustain a great strain on their legs and back while the technician climbs and/or maintains a position about the pole.

Conventional climbing equipment employed by a technician typically includes a pair of gaffs, a body belt, and/or a safety strap. In general, the gaff is a sharp blade protruding from the inside of the foot about mid-foot level and having straps that secure about the leg and/or feet of a technician. To climb, the technician drives one of the gaffs into the pole, steps up onto the gaff, and then drives the other gaff into the pole at a higher position. The technician continues taking steps up or "gaffs up" the pole until reaching a desired height.

The body belt is secured around the waist of the technician. The body belt includes pockets for carrying tools and rings (e.g., "D-rings") for attaching the safety strap. The safety strap typically includes a hook (e.g., snap buckle) at each end and a buckle for adjusting its length. During climbing, both hooks of the safety strap are attached to the same ring of the body belt on the left hip. Once in a position to perform line work, the technician releases one end of the safety strap from the body belt. The technician then wraps the safety strap around the pole and reattaches the end of the safety strap to the body belt, thus allowing the technician to use his hands at the desired working elevation. Thus, the technician uses the safety strap for climbing as well as supporting the technician in his working position about the pole.

During elevated line work, both gaffs are pressed into the pole and the technician leans back against the safety strap. This position allows the weight of the technician to be supported by the gaffs and the tension in the safety strap.

SUMMARY

In one general aspect, a support device includes a strap portion having a first end and a second end, a locking member for attaching the first end and the second end to form a loop, and a ring member for integrating the belt portion with a safety strap. The loop may extend around an elevated portion of a pole, the proposed belt portion may secure the safety strap to the pole, and the safety strap may attach to a body belt of a technician.

Implementations may include one or more of the following features. For example, the technician may be secured to the pole by the safety strap and at least one gaff having a blade portion extending into the pole. Contact between the safety strap and the pole may be maintained by the proposed belt portion in the event that the blade portion dislodges from the pole.

The ring member may encircle the belt portion and the safety strap. The ring member may maintain contact between an outer surface of the belt portion and an inner surface of the safety strap and/or slide along the belt portion and the safety strap. The ring member may be constructed of metal, polypropylene, reinforced fabric, leather, polyester, plastic, rubber and/or combination thereof.

In some implementations, the support device may include a connection member for mating with a corresponding connection member on the safety strap. Examples of a connection member include, but are not limited to, a snap, a hook, a loop, a clamp, a ring, and a patch (e.g., Velcro® patch, adhesive patch).

The support device may include an adjustment portion for adjusting the size of the loop. In some cases, the adjustment portion may be integral with the belt portion. The belt portion may be made of nylon webbing, polypropylene webbing, reinforced fabric, leather, polyester, plastic, rubber, metal, and/or a combination thereof. In some implementations, the belt portion may include a chain. The locking member may include a buckle assembly and/or a latching hook assembly, or an S-hook.

In another general aspect, a method includes attaching a support device so as to secure a safety strap to a pole. The safety strap may be attached to a body belt of a technician. The support device may include a belt portion having a first end and a second end, a locking member for attaching the first end and the second end, and a ring member for integrating the belt portion and the safety strap.

Implementations may include one or more of the following features. For example, attaching the support device may involve guiding the belt portion of the support device around the pole, positioning the ring member, attaching the first end of the belt portion to the second end of the belt portion, and adjusting the belt portion to tighten the support device. The belt portion and the safety strap may be integrated by at least one connection member, and attaching the support device may involve disconnecting the connection member.

The method may include ascending the pole, reaching a desired height, and/or securing the safety strap. Ascending the pole may involve driving a first gaff into the pole, stepping up onto the first gaff, and/or driving a second gaff into the pole at a higher position. The desired height may be a position suitable for performing line work. Securing the safety strap may involve releasing a first end of the safety strap from the body belt, wrapping the safety strap around the pole, and reattaching the first end of the safety strap to the body belt.

In another general aspect, an assembly includes a safety strap for securing a technician to a pole, a support device, and a ring member for integrating the safety strap and support device. The safety strap may be structured and arranged to extend around an elevated portion of a pole and attach to a body belt of a technician. The support device may be structured and arranged to secure the safety strap to the pole.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

DETAILED DESCRIPTION

It can be appreciated that commercial entities and other organizations that employ workers in elevated environments are aware of the potential risks attendant upon work performed in such environments. In view of this awareness, commercial entities and other organizations devote time and resources to promoting the safety safe as possible. Promoting safety of workers in elevated environments may involve instituting training programs and/or providing workers with a variety of support devices, support systems, backup devices and systems, and/or other means that promote the stability and safety of workers in elevated environments. Despite the best efforts of an organization to enhance the safety of its workers and reduce the risk of falling from elevated structures, for example, it is nonetheless difficult to eliminate all risks to workers performing work on such elevated structures.

Redundant systems for promoting safety of workers on elevated utility structures may thus sometimes be used. Such redundant systems can sometimes be beneficial in addition to the myriad of existing support systems, methods, devices and/or other apparatus employed by workers on elevated structures to reduce or mitigate risks associated with falling from utility structures, for example.

In one aspect, a pole support device secures a technician to a pole during elevated line work. The pole support device generally may be structured and arranged to keep a technician from falling if the gaffs of the technician cut out from the pole.

Figure 1:
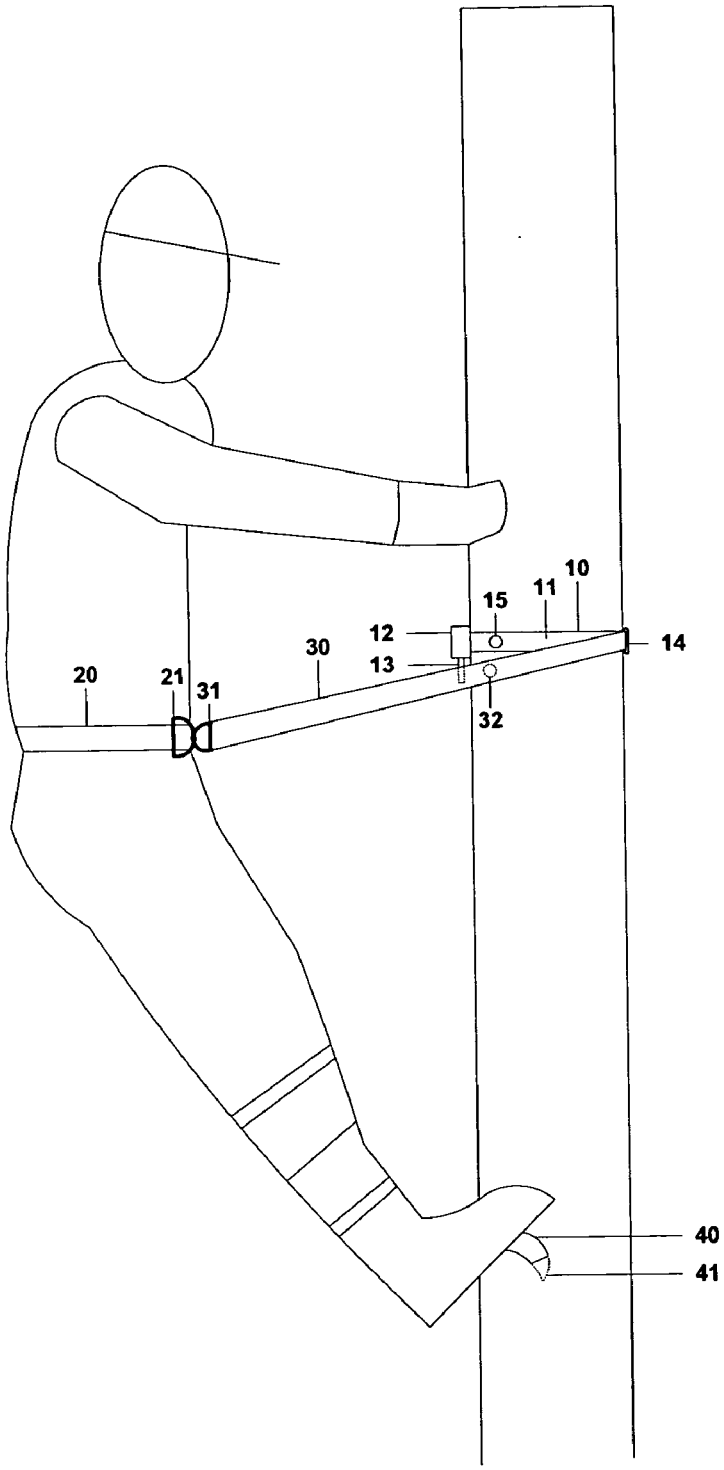
FIG. 1 illustrates one embodiment of a support device.

FIG. 1 illustrates one embodiment of a pole support device 10. As shown, the pole support device 10 may include a belt portion 11 and a locking member 12. In general, the belt portion 11 may be made of any type of flexible material having sufficient tensile strength to safely support the weight a technician. Examples include, but are not limited to, nylon or polypropylene webbing, reinforced fabric, leather, polyester, plastic, rubber, metal and/or combination thereof. While the dimensions may vary depending upon the particular implementation, in one embodiment, the belt portion 11 may be approximately one-inch wide.

The locking member 12 may be any type of device configured to secure ends of the belt portion 11 together to form a loop. In general, the type of locking member 12 that is used may depend on the particular implementation of the belt portion 11. For example, in embodiments in which the belt portion 11 is made of webbing (e.g., seat belt material) or leather, the locking member 12 may include a buckle assembly (e.g., two-piece buckle, post and hole) or a latching-hook assembly (e.g., sewn-in steel ring and S-hook or clevis slip hook). In an embodiment in which the belt portion 11 includes interconnected metal chain links, the locking member 12 may include an S-hook.

In some implementations, the size of the loop formed by the belt portion 11 may be adjusted. As shown in FIG. 1, the support device 10 may include an adjustment portion 13 that may be connected to and/or formed integrally with the belt portion 11. In one embodiment, pulling and/or lengthening the adjustment portion 13 causes the loop formed by the belt portion 11 to tighten around a pole, for example.

When positioned on a pole to perform elevated line work, a technician may utilize the pole support device 10. Examples of elevated line work include, but are not limited to installation, maintenance, and/or repair of serving terminals, wire pouches, J-hooks, network cable, and/or other communications equipment. In general, the pole may be any type of utility pole such as a telephone pole, for instance. In most cases, the pole will be tapered, i.e. the diameter of an upper portion of pole is smaller than the diameter of a lower portion of the pole.

As shown, the technician may wear a body belt 20 secured about the waist. The body belt 20 may include a pair of locking members 21 (e.g., D-rings, quick disconnects). The technician may connect the body belt 20 to a safety strap 30 by engaging locking members 21 with corresponding attachment members 31 (e.g., D-rings, quick disconnects) on the ends of the safety strap 30. The safety strap 30 may extend around the pole and connect with the body belt 20 worn by the technician. When the locking members 21 of the body belt 20 are engaged with the corresponding attachment members 31 of the safety strap 30, the technician is secured to the pole.

The technician also may wear a pair of gaffs 40. As depicted in FIG. 1, the gaffs 40 may include blade portions 41 that are driven into the pole by the technician. When the technician is in a position to perform elevated line work, the weight of the technician may be supported by the safety strap 30 and the gaffs 40.

In one aspect, the support device 10 is configured for integration with the safety strap 30. In general, integration of the support device 10 with the safety strap 30 enables the technician to secure the safety strap 30 to the pole when performing elevated line work and also allows the technician to easily transport the support device 10 and safety strap when climbing a pole, for example.

As shown in the embodiment of FIG. 1, the support device 10 includes a belt portion 11 wrapped around the pole and a locking member 12 securing together the ends of the belt portion 11. The belt portion 12 thus forms a loop around the pole. The size of the loop may be adjusted, for example, by pulling and/or lengthening the adjustment portion 13.

In this embodiment, the support device 10 further includes a ring member 14 for integrating the support device 10 with the safety strap 30. That is, the ring member 14 is structured and arranged to encircle both the belt portion 11 of the support device 10 and the safety strap 30. In some case, the ring member 14 may tightly hold the support device 10 and the safety strap 30 in snug contact. For example, when the belt portion 11 of the support device 10 is pulled taught around the pole, the outer surface of the belt portion 11 may contact the inner surface of the safety strap 30. In other cases, the ring member 14 may integrate the support device 10 and safety strap 30 loosely such that the ring member 14 may slide along the belt portion 11 and the safety strap 30.

In one implementation, the ring member 14 is configured to secure the safety strap 30 to the pole when a technician is performing elevated line work. In general, the ring member 14 may be made of any type of material having sufficient tensile strength to safely support the weight a technician.

Examples include, but are not limited to, metal (e.g., steel), polypropylene, reinforced fabric, leather, polyester, plastic, rubber, and/or combination thereof. In the event the some cases, the outer surface of the belt portion 11 may be in contact with the inner surface of the safety strap.

In the event that the gaffs 40 of the technician cut out, the integration of the support device 10 and safety strap 30 may hold the safety strap 30 in contact with the pole. Since the body belt 20 of the technician is locked to the safety strap 30, a descent by the technician may be prevented. Furthermore, even if the support device 10 is not tightened completely, the technician may only descend to a point where the taper of the pole is wide enough to catch and hold the support device 10.

In another implementation, the ring member 30 is configured to allow the technician to easily transport the support device 10 and safety strap 30. For example, to climb a pole (e.g., utility pole), the technician may wear a pair of gaffs 40 and ascends the pole by driving one of the gaffs 40 into the pole, stepping up onto the gaff, and then driving the other gaff into the pole at a higher position. During climbing, the safety strap 30 may be hooked to one of the locking members 21 on the body belt 20. The ring member 14 may integrate the support device 10 and the safety strap 30 so that the support device 10 and safety strap 30 may be transported together. In some cases, the ends of the support device 10 also may be hooked to the locking member 21 on the body belt 20. In such cases, the ring member 14 holds the support device 10 and the body belt 30 together and prevents excessive movement of the support device 10 during transport.

In one embodiment, the support device 10 further includes connection members 15 for engaging corresponding connection members 32 on the safety strap 30. When the connection members 15, 32 are mated, the ends of the support device 10 are connected to the safety strap 30. The ends of the support device 10 do not dangle and, therefore, there is less likelihood of catching the support device 10 on a protrusion or of entangling the support device 10 with the safety strap 30. In general, the connection members 15, 32 may be any type of mating or connecting structures. Examples include, but are not limited to, snaps, hooks, loops, clamps, rings, Velcro® patches, adhesive patches, etc.

Figure 2:
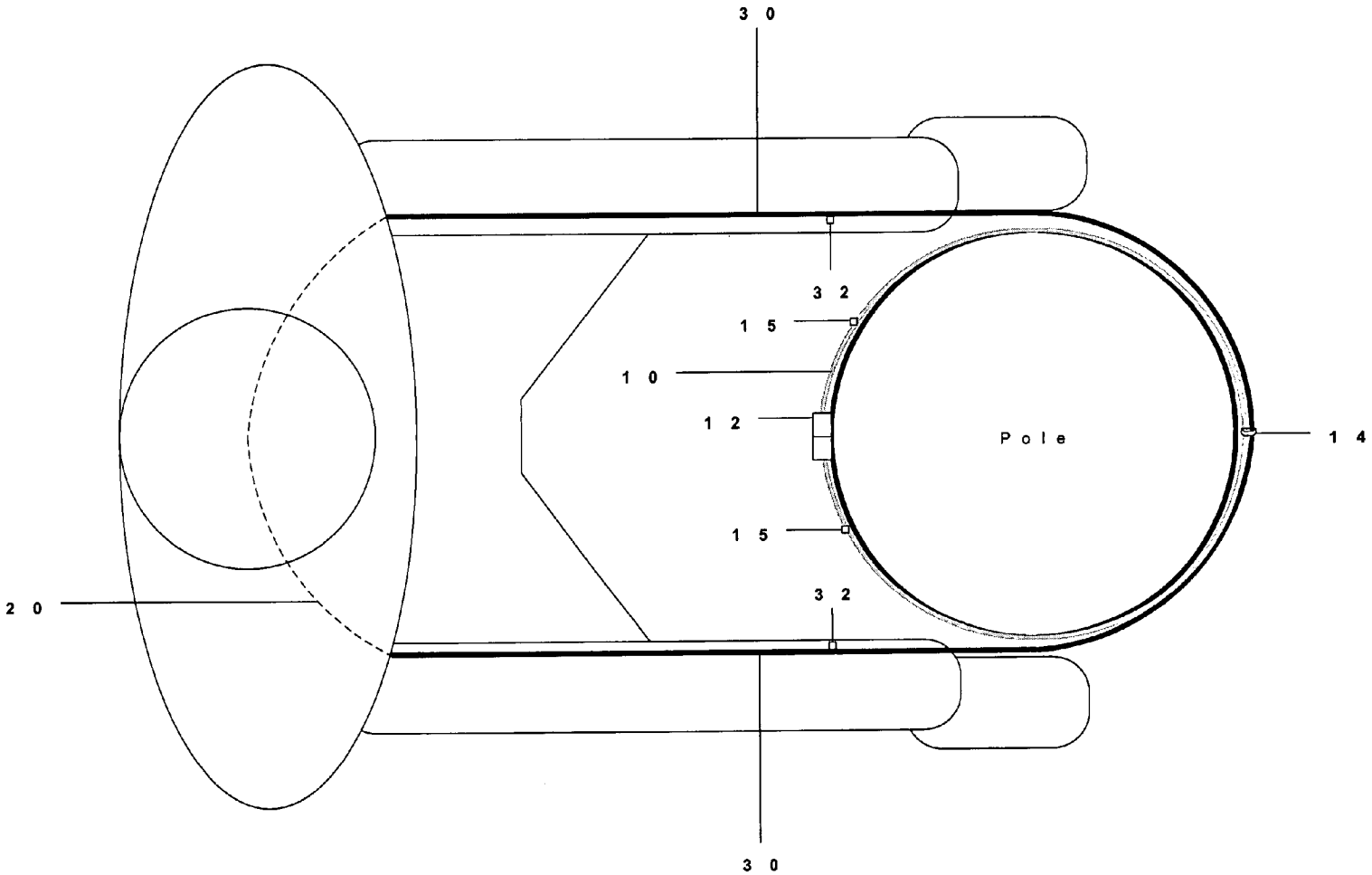
FIG. 2 illustrates one embodiment of a support device.

FIG. 2 further illustrates one embodiment of the pole support device 10. As shown, the body belt 20 and the safety strap 30 are connected and form a loop around the pole. The support device 10 includes a belt portion 11, a locking member 12, a ring member 14, and connection members 15. In this implementation, the belt portion 11 of the support device 10 extends around the pole and is connected to the safety strap 30 by the ring member 14. The safety strap 30 includes connection members 32 for engaging connection members 15 positioned on the belt portion 11 of the support device 10.

Figure 3:
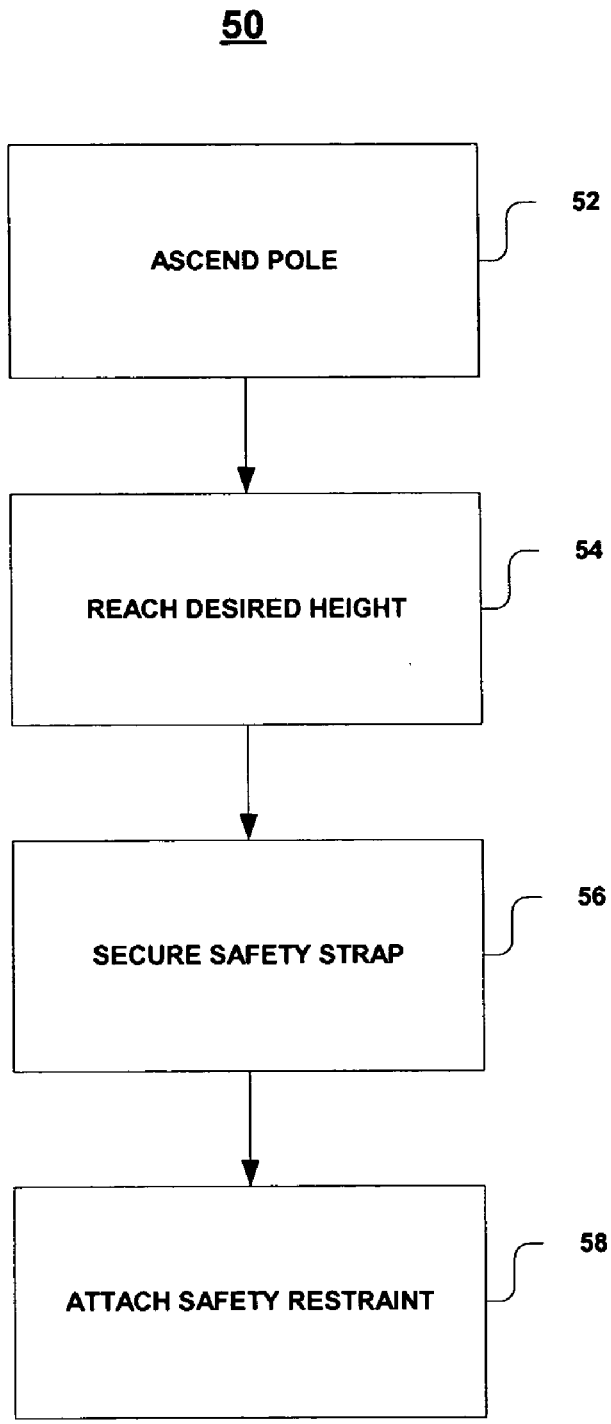
FIG. 3 is a flowchart of one embodiment of a support method.

FIG. 3 illustrates a flow chart for one embodiment of a support device method 50 for securing a technician to a pole during elevated line work. In general, the support device method 50 prevents a technician from decending if the gaffs of the technician cut out from the pole.

At step 52, a technician ascends a pole. In one implementation, the technician wears a pair of gaffs 40 and ascends the pole by driving one of the gaffs 40 into the pole, stepping up onto the gaff, and then driving the other gaff into the pole at a higher position. In general, the pole may be any type of utility pole such as a telephone pole, for instance. In most cases, the pole will be tapered, i.e. the diameter of an upper portion of pole is smaller than the diameter of a lower portion of the pole.

The technician also wears a body belt 20 having a safety strap 30 and/or a support device 10 attached thereto. During climbing, one or both of the safety strap 30 and the support device 10 may be hooked to one or more rings on the body belt. In one implementation, the support device 10 is integrated with the safety strap 30. In some cases, a ring member 14 and/or mating connection members 15, 32 (e.g., snaps, hooks, loops, clamps, rings, Velcro® patches, adhesive patch, etc.) may integrate the support device 10 and the safety strap 30.

At step 54, the technician reaches a desired height. In general, the technician continues taking steps up or "gaffs up" the pole until reaching a height suitable for performing elevated line work. Examples of elevated line work include, but are not limited to installation, maintenance, and/or repair of serving terminals, wire pouches, J-hooks, network cable, and/or other communications equipment.

At step 56, the technician secures the safety strap 30. Once in a position to perform line work, the technician releases one end of the safety strap 30 from the body belt 20 and wraps the safety strap 30 around the pole. The technician then reattaches the end of the safety strap 30 to the body belt 20, thus securing the technician to the pole. During elevated line work, both gaffs 40 are driven into the pole and the technician leans back against the safety strap 30. This position allows the weight of the technician to be supported by the tension in the safety strap 30 and the gaffs 40.

At step 58, the technician attaches the support device 10. In general, the support device 10 may be structured and arranged to secure the safety strap 30 to the pole. In one implementation, the technician unhooks the ends of the support device 10 from the body belt 20. In another implementation, where connection members 15, 32 integrate the support device 10 and the safety strap 30, the technician disconnects the support device 10 from safety strap 30.

Next, the technician guides the belt portion 11 of the support device 10 around the pole and slides the ring member 14 to the back of the pole. The technician then attaches the ends of the support device 10 and cinches it up. For example, the technician may connect the ends of the support device 10 using locking member 12 and may pull the support device 10 taught using the adjustment portion 13.

If the gaffs 40 of the technician should cut out, the integration of the support device 10 and safety strap 30 will prevent the technician from descending. In particular, as the technician begins to fall, the support device 10 and ring member 14 hold the safety strap 30 in contact with the pole. Because the body belt 20 of the technician, in turn, is locked to the safety strap 30, a complete descent may be prevented. In most cases, the technician may only descent a short distance before the support device 10 causes the safety strap 30 to catch and swing the technician toward the pole. The technician then can grab the pole and regain footing. Furthermore, even if the support device 10 is not tightened completely, the technician most likely may descend only to the point where the taper of the pole is wide enough to catch and hold the support device 10.

As described and illustrated, aspects of the present invention provide a way to secure a technician to a pole during elevated line work which keeps the technician from descending if the gaffs of the technician cut out from the pole.

The examples presented herein are intended to illustrate potential implementations of the present method and system embodiments. It can be appreciated that such examples are intended primarily for purposes of illustration. No particular aspect or aspects of the example method and system embodiments described herein are intended to limit the scope of the present invention. The configuration and specific functions of a particular support device, for example, are provided merely for convenience of disclosure.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein.

It can be appreciated that, in some embodiments of the present methods and systems disclosed herein, a single component can be replaced by multiple components, and multiple components replaced by a single component, to perform a given function. Except where such substitution would not be operative to practice the present methods and systems, such substitution is within the scope of the present invention.

Whereas particular embodiments of the invention have been described herein for the purpose of illustrating the invention and not for the purpose of limiting the same, it can be appreciated by those of ordinary skill in the art that numerous variations of the details, materials and arrangement of parts may be made within the principle and scope of the invention without departing from the invention as described in the appended claims.

What is claimed is:

1. A support device comprising:

a belt portion having a first end and a second end;

a locking member for attaching the first end and the second end to form a loop;

a ring member for integrating the belt portion with a safety strap; and at least one connection member for mating with a corresponding connection member of the safety strap to connect ends of the support device to the safety strap, wherein the loop is adapted to extend around an elevated portion of a pole, the belt portion is adapted to secure the safety strap to the pole, and wherein the safety strap is adapted to attach to a body belt of a technician.

2. The support device of claim 1, wherein the ring member is adapted to encircle the belt portion and the safety strap.

3. The support device of claim 2, wherein the ring member arranged to maintain contact between an outer surface of the belt portion and an inner surface of the safety strap.

4. The support device of claim 2, wherein the ring member is adapted to slide along the belt portion and the safety strap.

5. The support device of claim 4, wherein the adjustment portion is integral with the belt portion.

6. The support device of claim 2, wherein the ring member comprises one or more of: metal, polypropylene, reinforced fabric, leather, polyester, plastic, and rubber.

7. The support device of claim 2, wherein the belt portion is adapted to maintain contact between the safety strap and the pole if the blade portion dislodges from the pole.

8. The support device of claim 1, wherein the at least one connection member comprises one of: a snap, a hook, a loop, a clamp, a ring, and a patch.

9. The support device of claim 1, wherein the technician is secured to the pole by the safety strap and at least one gaff having a blade portion extending into the pole, wherein at least one of said ring member and said connection member prevents the technician from descending from the elevated portion of the pole if the blade portion of said gaff dislodges from the pole.

10. The support device of claim 1, further comprising an adjustment portion for adjusting a size of the loop.

11. The support device of claim 1, wherein the belt portion comprises at least one of nylon webbing, polypropylene webbing, reinforced fabric, leather, polyester, plastic, rubber, and metal.

12. The support device of claim 1, wherein the belt portion comprises a chain.

13. The support device of claim 1, wherein the locking member comprises at least one of a buckle assembly and a latching hook assembly.

14. A method for securing a technician to a pole comprising:

attaching a body belt of said technician to a safety strap; and securing said safety strap to a pole via a support device, wherein the support device includes: a belt portion having a first end and a second end; a locking member for attaching the first end and the second end; a ring member for integrating the belt portion and the safety strap; and at least one connection member for mating with a corresponding connection member of the safety strap to connect ends of the support device to the safety strap.

15. The support method of claim 14, wherein attaching the support device comprises:

guiding the belt portion of the support device around the pole;

positioning the ring member;

attaching the first end of the belt portion to the second end of the belt portion; and adjusting the belt portion to tighten the support device.

16. The support method of claim 14, wherein:

the belt portion and the safety strap are integrated by at least one connection member; and attaching the support device comprises disconnecting the at least one connection member.

17. The support method of claim 14, further comprising ascending the pole.

18. The support method of claim 14, wherein securing the safety strap comprises:

releasing a first end of the safety strap from the body belt;

wrapping the safety strap around the pole; and reattaching the first end of the safety strap to the body belt.

19. A support assembly comprising:

a safety strap for securing a technician to a pole, the safety strap extending around an elevated portion of a pole and attaching to a body belt of a technician;

a support device for securing the safety strap to the pole and for preventing the technician from descending from the elevated portion of the pole if a blade portion of a gaff attached to the technician dislodges from the pole; and a ring member for integrating the safety strap and support device wherein said safety strap includes a connection member for mating with a corresponding connection member of the support device to connect ends of the support device to the safety strap.

* * * * *